United States Patent [19]

Morgan

[11] 3,947,752

[45] Mar. 30, 1976

[54] CIRCUIT FOR CONVERTING ALTERNATING CURRENT VOLTAGES TO A CONSTANT MAGNITUDE DIRECT CURRENT VOLTAGE

[75] Inventor: Jack R. Morgan, Tempe, Ariz.

[73] Assignee: Motorola, Inc., Chicago, Ill.

[22] Filed: June 4, 1974

[21] Appl. No.: 476,180

[52] U.S. Cl. ..... 323/17; 323/22 T

[51] Int. Cl.[2] ..... G05F 1/56

[58] Field of Search..... 321/47; 323/17, 22 T, 23

[56] References Cited

UNITED STATES PATENTS

| | | | |
|---|---|---|---|
| 3,100,863 | 8/1963 | McCullough | 323/22 T |
| 3,336,521 | 8/1967 | Russell | 323/22 T X |
| 3,405,319 | 10/1968 | Barringer | 323/22 T |
| 3,638,102 | 1/1972 | Pelka | 323/22 T X |
| 3,643,152 | 2/1972 | Matsumura et al. | 323/22 T |

*Primary Examiner*—William M. Shoop
*Attorney, Agent, or Firm*—Michael D. Bingham; Maurice J. Jones; Harry M. Weiss

[57] ABSTRACT

An AC-DC regulator circuit is disclosed that is suitable for providing a constant magnitude, minimal ripple DC supply voltage in response to AC line voltages having varying peak amplitudes. The magnitude of the output voltage of the regulator is detected and restricted from exceeding a predetermined value by a feedback circuit employing a regenerative mode of operation. The resulting regulation provides a minimal ripple, constant magnitude supply voltage that may be applied to loads that are sensitive to voltage magnitude variations.

12 Claims, 3 Drawing Figures

CIRCUIT FOR CONVERTING ALTERNATING CURRENT VOLTAGES TO A CONSTANT MAGNITUDE DIRECT CURRENT VOLTAGE

BACKGROUND OF THE INVENTION

This invention relates to alternating current (AC) voltage-to-direct current (DC) voltage conversion circuits and particularly to a circuit for regulating input line voltages, that may vary in peak amplitudes, for providing a constant magnitude, minimal ripple amplitude supply voltage. Due to the difference between power distribution systems employed by different nations, applied line voltages may vary from as low as 90 volts, as used in Japan, to as high as 250 volts, as encountered in Europe. In the United States there is about a 20 percent variation of the nominal 120 volts on standard power transmission lines.

As a result, problems may be encountered by international travellers having small appliances, such as electric shavers, travel alarm clocks, or blenders, if the working voltage of the driving elements in such appliances is exceeded. In particular, some electric shavers contain a bulky AC wound motor that is used to drive the shaver heads. Presently, it is sometimes necessary to manually switch the shaver thereby tapping the correct proportion of the motor windings corresponding to the particular line voltage being used. The burden is on the user to see to it that this switching is properly performed in accordance with the different line voltages that may be encountered while travelling worldwide. If the traveller does not correct for the specific line voltages, the shaver may be destroyed by excessive currents.

The AC motor referred to in the previous paragraph also presents a production disadvantage in the manufacture of the electric shaver. AC motors are bulky and expensive by nature. It is therefore desired to use small, inexpensive direct current motors requiring minimum working voltage. An AC-to-DC regulator circuit capable of providing a high degree of regulation with varying amplitudes of input line voltages is required to facilitate the use of such DC motors.

Although present AC-DC regulators are adequate for regulating input voltages that have amplitudes that vary 10 to 20 percent, these regulators are not suitable to be used in small appliances in which the peak amplitude of the input line voltage varies over 100 percent. To maintain nominal working voltages of 100 volts in response to line voltages with amplitudes of 250 volts, present regulators generally have to conduct currents of large magnitudes. To withstand the resulting power dissipation, it is necessary to use high power semiconductor devices and heat sinking to provide protection to such devices. This undesirably increases the physical size of such regulators. Moreover, power devices are expensive and provide disadvantages in a marketing environment that demands minimal production costs.

Another problem common to most present regulators is that of transients. Transient voltages can occur during either connection or disconnection of the regulator from the line voltage supply. If the transient voltage causes a false trigger signal to occur simultaneously with the peak value of the applied line voltage, the output voltage of the regulator could exceed the rating of the motor and destroy it.

Thus, a need exists for a regulator circuit providing a constant output voltage and which is operable in environments in which extreme amplitude variances in line voltages occur and which does not require manual switching techniques to protect the circuit. A need also exists to develop a regulator circuit which is not damaged by false triggering in response to transients.

SUMMARY OF THE INVENTION

It is an object of this invention to provide an improved AC-DC regulator circuit.

Another object is to provide a regulator circuit which is responsive to AC line voltages having peak amplitudes which vary from 90 to 250 volts to provide a minimum ripple output voltage having a constant, predetermined magnitude.

A further object is to provide a regulator circuit which discriminates against voltage transients to eliminate undesired voltage stresses on circuit components.

A still further object is to provide a regulator circuit which is suitable for being included in small appliances having DC motors requiring constant supply voltages.

The regulator circuit structure of the invention is suitable for providing a direct current (DC) output voltage of a predetermined magnitude in response to alternating current (AC) input voltages that have varying peak amplitudes. Moreover, the regulator circuit discriminates against voltage transients reducing voltage and current stresses on circuit components. The regulator circuit includes a bridge rectifier, an impedance or current control device, a sensing circuit, and a regenerative switch employing a feedback circuit. The bridge rectifier circuit has input terminals to which the AC input voltage is applied and output terminals at which a rectified voltage is developed. The impedance of current control device has two principal terminals and a control terminal with the first principal terminal connected to one of the output terminals of the rectifier and the other principal terminal connected to the regulator output terminal. A sensing circuit is connected to the control terminal of the impedance control device and provides a control signal for increasing and decreasing the impedance of the impedance control device whereby current is either prevented or allowed to flow respectively.

A feedback circuit connected in parallel with the two principal terminals of the impedance control device provides a feedback signal at an output terminal thereof. The regenerative switch is connected to the sensing circuit and to the output terminal of the feedback circuit and responds to the feedback signal to effectively increase the rate of impedance change of the impedance control device. A filtering component connected between output terminals of the regulator circuit develop a constant magnitude DC voltage.

DETAILED DESCRIPTION OF THE PREFERRED EMBODIMENT

Figure 1:
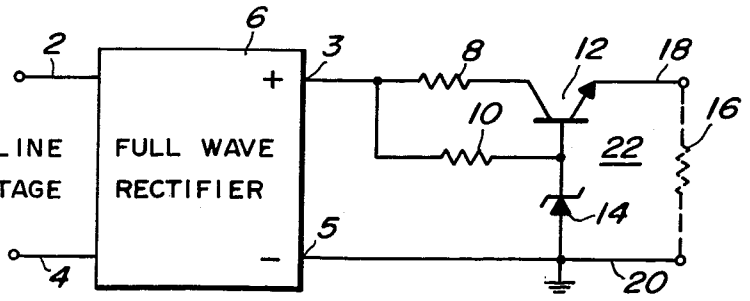
PRIOR ART FIG. 1
FIG. 1 is a partial block and partial schematic diagram illustrating a prior art regulator circuit.

A prior art circuit will be described along with some of the problems therewith so that the advantages of the regulator circuit structure of the present invention can be more fully appreciated. Referring to FIG. 1, a prior art series pass regulator circuit is shown.

An AC input voltage is provided between input terminals 2 and 4 of full wave rectifier 6. The full wave rectifier is connected in a conventional manner to provide a DC voltage of varying magnitude that is positive at output terminal 3 with respect to output terminal 5 in response to the AC input voltage at terminals 2 and 4. The rectifier functions as a power supply for the prior art regulator transistor 12. Transistor 12 receives collector current through resistor 8. The emitter of transistor 12 is connected to regulator output terminal 18. Resistor 8 is interposed between the collector of transistor 12 and positive terminal 3 of rectifier 6. The base of transistor 12 is coupled to positive terminal 3 of rectifier 6 through resistor 10. The base of transistor 12 is also returned to the reference terminal 5 of rectifier 6 through zener diode 14. Regulator output terminal 20 is connected to reference terminal 5. The components 8, 10, 12 and 14 form a prior art, series pass regulator circuit 22.

In operation, the unregulated rectified voltage between terminals 3 and 5 of rectifier 6, is normally conducted through transistor 12 to load 16. As the magnitude of the load voltage exceeds the breakdown voltage of zener diode 14, zener diode 14 begins to conduct thereby starving base drive current to transistor 12. With less base drive current, the effective impedance of transistor 12 increases, which also increases the voltage drop between its collector and emitter, and decreases the load voltage across load 16. As a result of this operation, the load voltage will not increase beyond a predetermined value.

Several problems are presented by the aforedescribed prior art regulator circuit if coupled to power transmission lines having varying line voltages as described in the "Background of the Invention". If the magnitude of the desired output voltage is much less than the peak amplitude of the input AC line voltage, undesirable voltage and current stresses are placed on the regulator components. More specifically, a large voltage drop is developed across transistor 12 which also may be required to provide a large current. Also under these conditions, zener diode 14 conducts a large current. Hence, transistor 12 and zener diode 14 must be "power devices". Such power devices are not only expensive but are also bulky, which therefore makes them undesirable where circuit costs and space are limited, such as in small appliances.

Figure 2:
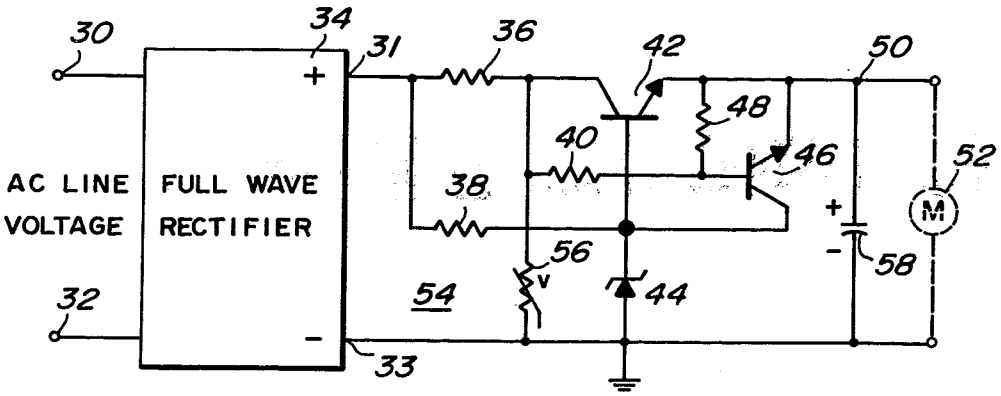
FIG. 2 is a partial block and partial schematic diagram illustrating a closed loop regulator circuit of one embodiment of the invention.

Referring to FIG. 2, a closed loop regulator of the preferred embodiment of this invention is shown which provides solutions to the aforementioned problems. An AC input voltage is provided between input terminals 30 and 32 of full wave rectifier 34. The rectifier which is connected in a conventional manner, provides a varying DC voltage which is positive at output terminal 31 of rectifier 34 with respect to the voltage at output terminal 33. Rectifier 34 also functions as a power supply for the regulator circuit. The collector and base of transistor 42 are coupled to the positive terminal of rectifier 34 through resistors 36 and 38, respectively. The emitter of transistor 42 is connected to regulator output terminal 50 and to filter capacitor 58.

In this configuration, transistor 42 controls the impedance and thereby switches the current off and on between the input of and the output terminals of the regulator. Zener diode 44 is connected between the base of transistor 42 and terminal 33. The circuit of FIG. 2, as thus far described, is the same as the prior art circuit of FIG. 1. To eliminate the problems presented heretofore, a switch comprised of transistor 46 and a feedback circuit including resistor 40 and 48 is employed in a regenerative fashion. Resistors 40 and 48 are connected in series between the collector and emitter of transistor 42. The collector of transistor 46 is connected at the junction of the base of transistor 42 and cathode of zener diode 44, and the emitter of transistor 46 is connected to the emitter of transistor 42. Base current is supplied to transistor 46 through resistor 40 with the base of transistor 46 being connected to the node between resistor 40 and 48.

Figure 3:
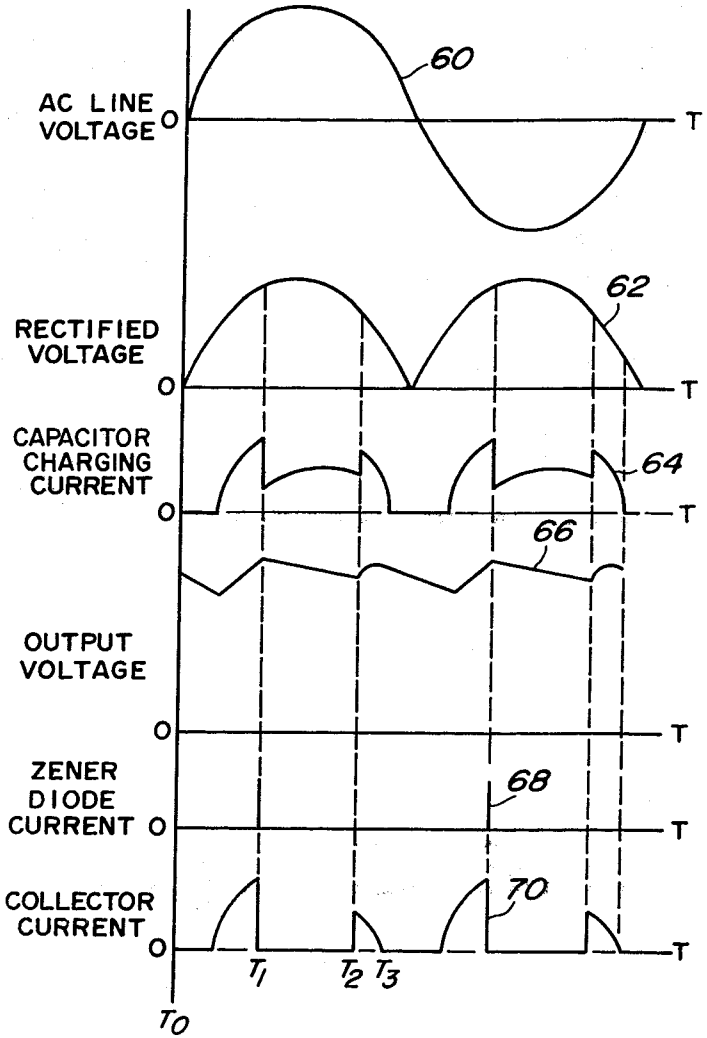
FIG. 3 is a chart of waveforms illustrating the operation of the circuit of FIG. 2.

The operation of the circuit of FIG. 2 is explained with the aid of the waveform chart of FIG. 3. Rectifier 34 is adapted to receive the AC line voltage, waveform 60, between the input terminals thereof and provides a rectified voltage, waveform 62, at output terminals 31 and 33. At the beginning of the first half cycle of waveform 62, at time $T_0$, as the rectified voltage is going positive, transistor 42 is turned on in response to the base current supplied through resistor 38. As the magnitude of the rectified voltage continues to increase, transistor 42 becomes saturated and conducts more current, waveform 70, that charges capacitor 58. This action continues until the magnitude of the voltage across capacitor 58, as indicated by waveform 66 at time $T_1$, reaches a reference value that is one diode drop below the breakover voltage of zener diode 44. Zener diode 44 then begins to conduct, causing transistor 42 to come out of saturation. The resistive divider comprised of resistors 40 and 48 then begins to provide base drive to transistor 46 in response to the increased voltage dropped across transistor 42. Consequently, transistor 46 begins to conduct. As transistor 46 begins to turns on, more base drive is removed from transistor 42 rapidly turning it off and thereby regeneratively rendering transistor 46 more conductive. Waveform 68 illustrates that current flows through zener diode 44 only during the regenerative switching action just described at time $T_1$. Therefore, zener diode 44 can be a low power device thereby reducing costs and saving space.

As illustrated by waveform 64, between times $T_1$ and $T_2$, current is supplied to capacitor 58 through resistors 36, 38, 40, 48 and transistor 46. The values selected for resistors 36, 38, 40 and 48 are such that capacitor 58 will discharge through motor load 52 between times $T_1$ and $T_2$. In other words, there is not sufficient current supplied by the aforementioned resistors to charge capacitor 58 between times $T_1$ and $T_2$, as illustrated by waveform 66.

The magnitude of the rectified voltage is decreasing, as shown by waveform 62, during the last portion of the rectified voltage half cycle. Consequently, the value of the rectified voltage eventually approaches the voltage level across filter capacitor 58 at time $T_2$. At time $T_2$, the current supplied to transistor 46 through resistive dividers 36, 40 and 48 is not sufficient to render transistor 46 conductive. Thus, transistor 42 is regeneratively pulled into saturation because of the base current supplied to it through resistor 38. Hence, filter capacitor 58 is charged between times $T_2$ and $T_3$ during the last portion of the rectified voltage half cycle. As the output voltage of the full wave rectifier drops below the voltage across filter capacitor 58, as shown by waveform 64, at time $T_3$, transistors 42 and 46 turn off. The regulator is then ready to repeat the above-described cycle.

The switch comprising transistor 46 reduces the power dissipation in transistor 42 and zener diode 44 in the following manner. Twice during each cycle of the AC line voltage, as the rectified voltage passes through its peak value, the collector current of transistor 42, as shown by waveform 70, is reduced to zero by the switching action of transistor 46. Waveform 68 illustrates that current flows through zener diode 44 only at the same time that transistor 42 is turning off which is at time $T_1$. Therefore, an undesirable condition that exists in prior art circuits, for instance high current density through transistor 12 and zener diode 14 during peak voltages, is eliminated by the embodiment of FIG. 2.

Another important consideration relating to regulator circuits is the transient condition that occurs when the regulator is initially connected to the AC line. The worst possible transient condition occurs in response to peak AC line voltages.

Referring now to FIG. 2, with the AC input voltage at a peak value, the voltage applied to the regulator circuit through full wave rectifier 34 is also at a peak value. If it is assumed that capacitor 58 is initially uncharged, a condition is created wherein maximum power could be dissipated through transistor 42. If a substantial amount of current is allowed to flow under this condition, transistor 42 could be damaged.

During the initial conditions, transistor 42 is restricted from turning fully on as is explained in the following manner. Transistor 42 is selected to have an insufficient beta characteristic so that it cannot immediately become saturated in response to the bias voltages developed across resistors 36 and 38. Because transistor 42 is not immediately saturated, a sufficient voltage magnitude is generated across the voltage divider network comprising resistors 40 and 48 to cause transistor 46 to conduct. As transistor 46 conducts, the regenerative action previously described is repeated whereby transistor 42 is rendered nonconductive. Therefore, transistor 42 is protected from being overstressed due to high power conditions that may occur when the regulator is initially connected to the AC line.

Varistor 56, which is connected between the collector of transistor 42 and circuit ground, serves to protect the regulator circuit against transient voltages that may occur during steady state operation. The function of varistor 56 is to clamp the voltage appearing at the collector of transistor 42 to a level so as to prevent collector-to-emitter breakdown. When transistor 42 is normally in a nonconductive state because of the regenerative action of transistor 46, if a line voltage transient occurs, the collector-to-emitter breakdown voltage of transistor 42 could be exceeded. However, varistor 56 is selected such that the voltage transient causes varistor 56 to be rendered conductive and thereby effectively shunting the transient voltage away from the collector of transistor 42.

The following table of resistor values is given by way of illustration only and lists those values used in the regulator circuit of the type shown in FIG. 2 which was actually built and successfully tested.

TABLE

| RESISTOR (R): | | VALUE | RATING |
|---|---|---|---|
| 36 | ohms | 300 | 3 watts |
| 38 | ohms | 7500 | 3 watts |
| 40 | ohms | 7500 | 3 watts |
| 48 | ohms | 100 | 0.5 watts |
| CAPACITOR (C): | | | |

TABLE-continued

| RESISTOR (R): | | VALUE | RATING |
|---|---|---|---|
| 58 | microfarads | 15 | 150 volts |
| TRANSISTOR (T): | | | |
| 42 | | MJE 340 | |
| 46 | | MPS A20 | |

Several advantages are obtained by the embodiment of FIG. 2 over prior art regulator circuits. In conjunction with regulator circuit 54, a variety of different loads that require a specific DC minimum ripple voltage may be used in an appliance that has an applied voltage that may vary in amplitude. The embodiment of FIG. 2 also provides for minimum power dissipating devices to be used, thereby eliminating heat sink problems in the use of expensive components.

While the above detailed description has shown and described the fundamental novel features of the embodiment of this invention, it will be apparent to those skilled in the art that many changes and modifications may be made without departing from the spirit of the invention.

What is claimed is:

1. A regulator circuit for providing a direct current output voltage of a predetermined magnitude at output terminals thereof in response to applied alternating current input power, the input power having peak amplitudes which vary in magnitude, the regulator circuit comprising:

rectifier means responsive to said applied input power for deriving unidirectional power across first and second output terminals thereof;

impedance control means having first, second and control electrodes for changing the magnitude of the impedance developed across said first and second electrodes thereof, said first electrode being connected to one of said output terminals of the regulator circuit;

first resistive means interposed between said first output terminal of said rectifier means and said second electrode of said impedance control means;

voltage reference means for sensing the magnitude of the output voltage of the regulator circuit and being momentarily rendered operative to cause an initial change in said impedance of said impedance control means, said voltage reference means having first and second electrodes, said first electrode being operatively coupled to said control electrode of said impedance control means and to said first output terminal of said rectifier means, said second electrode being connected to said second output terminal of said rectifier means and to the other of said output terminals of the regulator circuit;

feedback means connected between said first and second electrodes of said impedance control means and having an output terminal for providing a feedback signal in response to said impedance change of said impedance control means; and switching means responsive to said feedback signal for regeneratively increasing the rate of impedance change of said impedance control means in response to said initial impedance change, said switching means being operatively coupled between said output terminal of said feedback means, said first electrode of said impedance control means and said first electrode of said voltage reference means.

2. The regulator circuit of claim 1 wherein said regulator circuit further includes in combination:

filter means connected in series between said first electrode of said impedance control means and said second electrode of said voltage reference means, said filter means providing a substantially constant output voltage across terminals thereof; and second resistive means coupling said first electrode of said voltage reference means to said first output of said rectifier means.

3. The regulator circuit of claim 2 wherein:

said impedance control means includes a first transistor having emitter, collector and base electrodes, said emitter, collector and base electrodes being said first, second and control electrodes respectively; and said switching means including a second transistor having emitter, collector and base electrodes, said emitter electrode being connected to said emitter electrode of said impedance control means, said collector electrode being connected to said first electrode of said voltage reference means and said base electrode being connected to said output terminal of said feedback means.

4. The regulator circuit of claim 3 wherein said feedback means further including in combination:

third resistive circuit means coupling said collector electrode of said first transistor to said output terminal of said feedback means; and fourth resistive circuit means connected in series between said emitter electrode of said second transistor and said output terminal of said feedback means.

5. The regulator circuit of claim 4 wherein said voltage reference means further comprising a zener diode.

6. A circuit for regulating an alternating current voltage suitable for providing a constant output voltage in response to alternating current voltages that have varying peak amplitudes comprising:

rectifier means connected to the input of the regulator circuit and deriving a rectified direct current voltage at output terminals thereof in response to an alternating current voltage supplied to input terminals of said rectifier;

impedance control means having first and second principal terminals and a control terminal, said first principal terminal being connected to the positive output terminal of said rectifier means, said second principal terminals being connected to an output terminal of the regulator circuit;

voltage reference means for detecting the magnitude of the output voltage across a load, said voltage reference means being connected in series between said control terminal of said impedance control means and to the ground reference output terminal of said rectifier means, and increasing the voltage across said impedance control means as the magnitude of said load voltage exceeds a predetermined value;

feedback means connected across said impedance control means and being responsive to increases in said voltage across said impedance control means and in response thereto providing a control signal of increasing magnitude at an output terminal thereof;

regenerative switching means connected to said voltage reference means and to said feedback means being responsive to said control signal from said feedback means for effectively increasing said voltage across said impedance control means;

circuit protection means connected between said impedance control means and said ground reference output terminal of said rectifier means said circuit protection means being responsive to voltage transients and providing protection to said impedance control means;

said sensing means includes a zener diode; and said circuit protection means includes a varistor.

7. The circuit of claim 6 wherein:

said impedance control means comprises a transistor of one conductivity type; and said regenerative switching means comprises a transistor of the same conductivity type.

8. The circuit of claim 6 wherein said rectification means is also connected to provide power for said regenerative switching means.

9. A regulator circuit, comprising in combination:

rectifier means for providing unidirectional power at first and second output terminals thereof in response to applied alternating current power being supplied to the regulator circuit;

first resistive means having first and second terminals, said first terminal being connected to said first output terminal of said rectifying means;

a transistor switch having base, collector and emitter electrodes for alternately conducting and preventing current from flowing therethrough in response to the magnitude of the output voltage of the regulator circuit being, respectively, less than or substantially equal to or greater than a predetermined value, said transistor switch being in a saturated condition when said current is conducted therethrough, said collector electrode being connected to said second terminal of said first resistive means, said emitter electrode being connected to a first output terminal of the regulator circuit;

means having first and second electrodes for sensing when the magnitude of the output voltage of the regulator circuit becomes substantially equal to or greater than said predetermined value to cause said transistor switch to be in a nonsaturated condition thereby causing an initial increase in the magnitude of the impedance of said transistor switch, said first electrode of said sensing means being connected to said base electrode of said transistor switch, said second electrode being connected to said second output terminal of said rectifying means and to a second output terminal of the regulator circuit;

feedback means connected to said base, collector and emitter electrode of said transistor switch for regeneratively increasing the rate of impedance change of said transistor switch when the output voltage becomes substantially equal to or greater than said predetermined value; and second resistive means coupled between said first output terminal of said rectifier means and said base of said transistor switch for providing a driving current to said feedback means when said impedance of said transistor changes.

10. The regulator circuit in accordance with claim 9 wherein said feedback means further includes a transistor.

11. The regulator circuit in accordance with claim 9 wherein said sensing means further includes a zener diode.

12. The regulator circuit in accordance with claim 9 wherein:

said transistor switch includes a bipolar transistor;

said sensing means includes a zener diode; and said feedback means includes a bipolar transistor.

* * * * *